US009492052B2

(12) United States Patent
Ak et al.

(10) Patent No.: US 9,492,052 B2
(45) Date of Patent: Nov. 15, 2016

(54) DISHWASHER COMPRISING A MICROFILTER

(75) Inventors: Gokhan Ak, Istanbul (TR); Orhan Atabey, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 752 days.

(21) Appl. No.: 13/519,125

(22) PCT Filed: Dec. 16, 2010

(86) PCT No.: PCT/EP2010/069844

§ 371 (c)(1), (2), (4) Date: Oct. 8, 2012

(87) PCT Pub. No.: WO2011/076650

PCT Pub. Date: Jun. 30, 2011

(65) Prior Publication Data

US 2013/0186441 A1 Jul. 25, 2013

(30) Foreign Application Priority Data

Dec. 25, 2009 (TR) ..... a 2009/09819

(51) Int. Cl.
*A47L 15/42* (2006.01)

(52) U.S. Cl.
CPC ..... *A47L 15/4208* (2013.01); *A47L 15/4206* (2013.01); *A47L 15/428* (2013.01)

(58) Field of Classification Search
CPC ..... A47L 15/4208
See application file for complete search history.

(56) References Cited

U.S. PATENT DOCUMENTS

| | | | | |
|---|---|---|---|---|
| 7,350,527 | B2 * | 4/2008 | Gurubatham et al. | 134/104.1 |
| 2002/0014260 | A1 | 2/2002 | Kim et al. | |
| 2006/0237050 | A1 | 10/2006 | Weaver et al. | |

FOREIGN PATENT DOCUMENTS

| | | | |
|---|---|---|---|
| DE | 10244243 | A1 | 3/2004 |
| DE | 102007061038 | A1 | 6/2009 |
| EP | 0748607 | A2 | 12/1996 |

* cited by examiner

*Primary Examiner* — Jason Ko

(74) *Attorney, Agent, or Firm* — Kilpatrick Townsend & Stockton LLP

(57) ABSTRACT

The dishwasher (1) of the present invention comprises a washing tub (2) wherein items to be washed are placed, a receptacle (3) which is located at the lower portion of the washing tub (2) and wherein the water in the washing tub (2) is collected during the washing process, a hollow cylindrical microfilter (5) which is located in the middle of the receptacle (3) and which holds the residues carried by the water that passes from the receptacle (3) to the water circulation line, a pump (4) which returns the water accumulated in the receptacle (3) to the washing tub (2), an additional line (6), one end of which is connected to the pump (4) and the other end opening to the middle of the microfilter (5), and a sprayer (8) which is disposed into the microfilter (5) and which has more than one nozzle (7) that are located on the surface of the sprayer (8) and that provide the water supplied from the pump (4) by means of the additional line (6) to be sprayed towards the inner surface of the microfilter (5).

5 Claims, 6 Drawing Sheets

DISHWASHER COMPRISING A MICROFILTER

Figure 1:
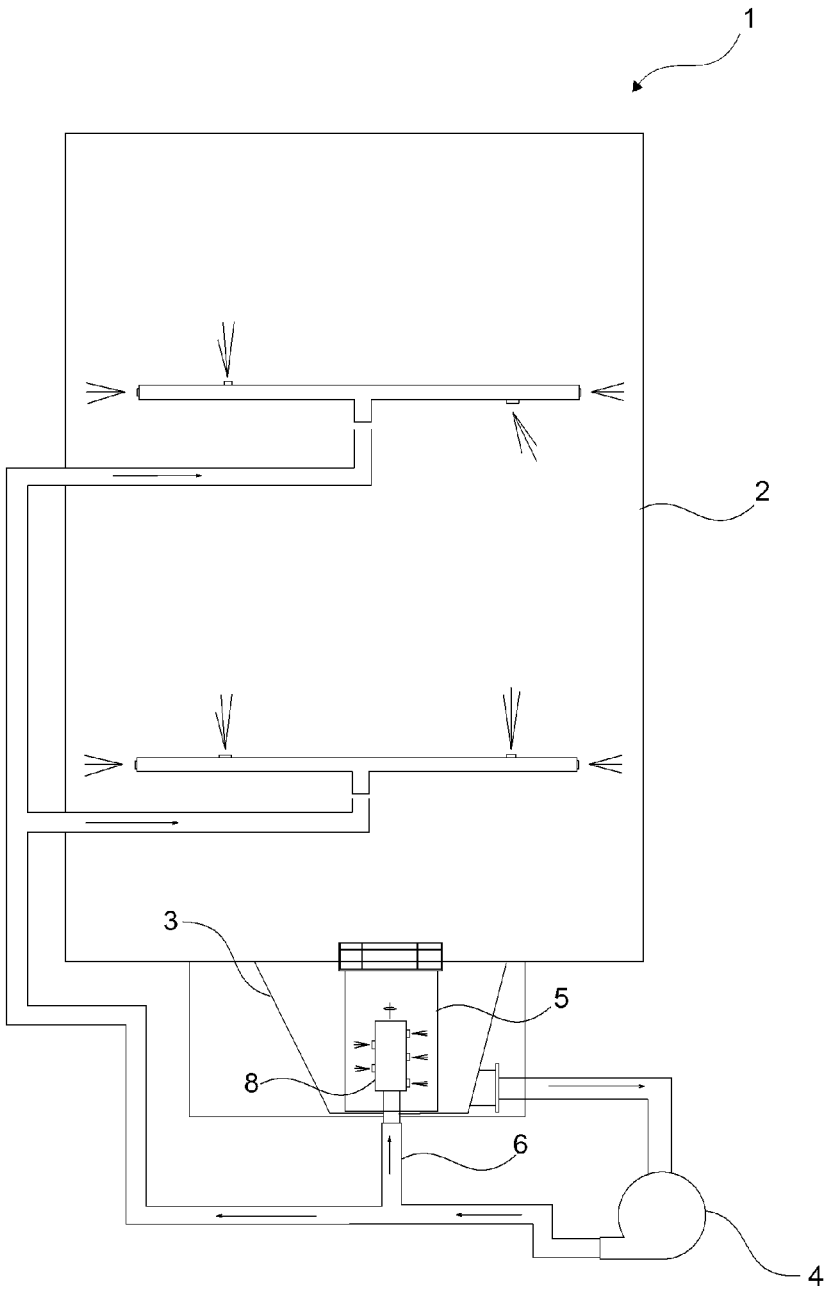

The present invention relates to a dishwasher comprising a microfilter.

In dishwashers, at the lower portion of the washing tub, a washing receptacle wherein the water in the washing tub is collected during the washing process and a microfilter disposed in the middle of the washing receptacle are situated. The microfilter clogs due to the residues adhering thereon after consecutive washings. This decreases the washing performance of the dishwasher after a while and makes the filtration system dysfunctional. To prevent this, the user is required to remove and clean the microfilter at certain periods. However, many users never clean the microfilter or cannot replace it properly after the cleaning. The microfilter not being cleaned or its erroneous assembly causes the washing performance to decrease. For this reason, in the state of the art, various solutions have been developed for the microfilter to clean itself.

In the state of the art Patent Application No US2006237050, a dishwasher comprising a filter cleaning system is described.

The aim of the present invention is the realization of a dishwasher comprising a microfilter which can be cleaned without requiring user intervention.

The dishwasher realized in order to attain the aim of the present invention and explicated in the claims comprises a receptacle which is located at the lower portion of the washing tub and wherein the water in the washing tub accumulates during washing, and a hollow cylindrical microfilter which is located inside the receptacle and holds the residues carried by the water and thus, prevents them from passing to the washing tub. The dishwasher comprises an additional line, one end of which is connected to the pump and the other end opens to the middle of the microfilter, and a sprayer which is mounted to the end of the additional line and disposed into the microfilter. Water is supplied into the sprayer by means of the additional line. Nozzles are situated on the outer surface of the sprayer which are disposed such that the exit direction of the water exiting their orifices will be in the same rotational direction and the nozzles will be almost tangential to the sprayer surface. The water filling into the sprayer is sprayed to the inner surface of the microfilter by means of the nozzles. Since the water sprayed through the nozzles exits by skimming the sprayer surface in a pressured manner, it creates a moment force such that it will rotate the sprayer around its own axis. Thus, the sprayer provides the residues adhered to the microfilter surface to be removed by rotating and spraying water to the inner surface of the microfilter. Consequently, the microfilter is provided to be cleaned without requiring user intervention. Since cleaning the microfilter will increase the filtration quality, the washing performance of the dishwasher is improved.

In an embodiment of the present invention, the sprayer rotates in the direction opposite to the direction of the natural vortex of the water that is formed inside the receptacle during the suction of the pump. The nozzles are disposed tangential to the sprayer surface such that the exit direction of the water exiting their orifices will be opposite to the water suction direction of the pump. Since the rotation of the sprayer is realized by the moment force created by the water that is sprayed through the nozzles, the rotational direction of the sprayer is also determined by the exit direction of the water from the nozzles. By rotating the sprayer in the direction opposite to the vortex direction of the water that is formed inside the receptacle during the water suction of the pump, suction of the residues and filths, which are adhered to the microfilter surface, during the suction of the pump is eliminated.

In an embodiment of the present invention, the sprayer is configured as a truncated cone. Thus, since the speed of the water reaching the upper end of the sprayer increases, the rotational efficiency of the sprayer is increased. By the sprayer rotating faster, the residues and filths adhered to the microfilter surface are removed more easily.

In another embodiment of the present invention, the sprayer is configured cylindrically. Thus, the sprayer is produced in a simple and easy manner.

In another embodiment of the present invention, the sprayer is located almost at the center of the microfilter. Thus, since the nozzles on the sprayer are almost at the equal distance to the microfilter surface, the water sprayed through the nozzles is provided to hit all the surfaces of the microfilter and hence, the residues and filths adhered to the microfilter surface are provided to be cleaned effectively.

In another embodiment of the present invention, a valve is situated that is located on the additional line. By means of the valve, the water feed made to the sprayer is performed in a controlled manner.

In another embodiment of the present invention, before the water inside the receptacle is discharged at the end of the rinsing step, the water in the receptacle is directed only to the additional line by means of the valve. The dishwasher, furthermore, has a control unit that controls the water flow in the valve. The water passing to the sprayer by means of the additional line is sprayed to the microfilter surface through the nozzles. Thus, the microfilter is provided to be cleaned after the rinsing step. Since there is no possibility of adhering of residue and filth to the microfilter surface after the rinsing step, the microfilter is present in a clean state for next washings. Consequently, the filtration performance of the microfilter is increased and hence, the cleaning efficiency of the dishwasher is increased.

In another embodiment of the present invention, the dishwasher has a microfilter cleaning step which is executed by the control unit independently of the washing steps and which is enabled to be selected by the user by means of the user interface. Thus, the user is provided to perform the microfilter cleaning process at any desired time.

By means of the present invention, the residues and filths adhering to the microfilter surface are provided to be cleaned without requiring user intervention and thus, the filtration performance of the microfilter is increased. Consequently, the washing efficiency of the dishwasher is also improved.

A dishwasher realized in order to attain the aim of the present invention is illustrated in the attached figures, where:

FIG. 1—is the schematic view of a dishwasher.

Figure 2:
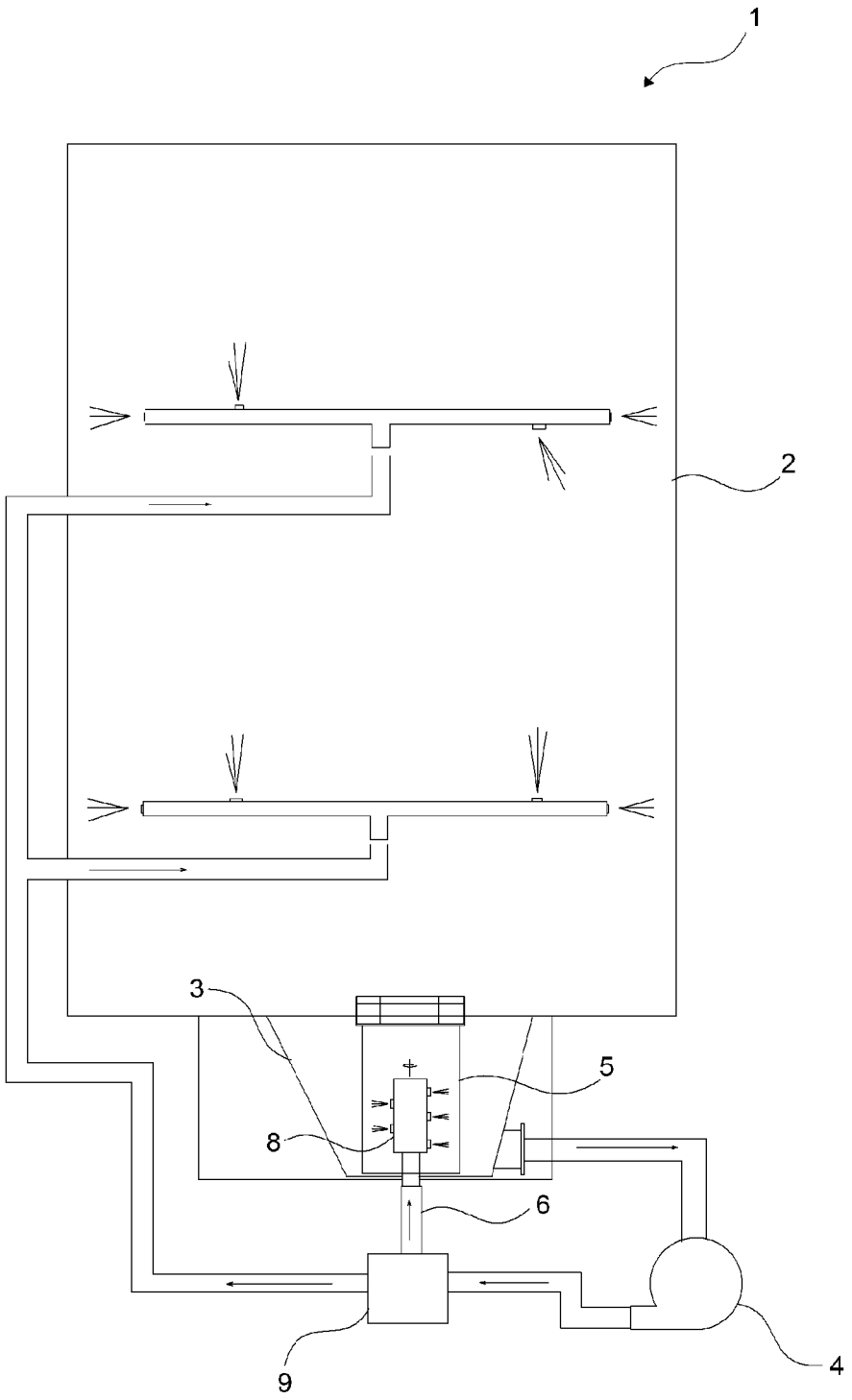

FIG. 2—is the schematic view of the dishwasher relating to another embodiment of the present invention.

Figure 3:
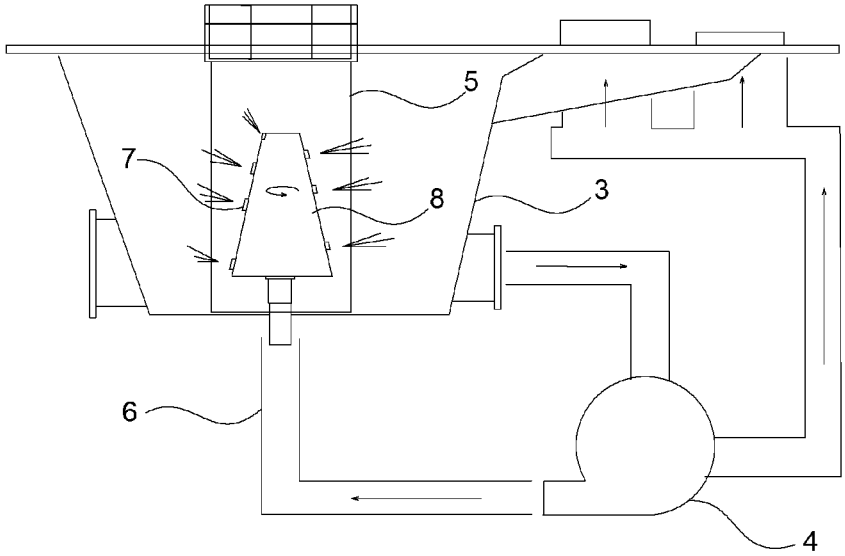

FIG. 3—is the schematic view of a receptacle, microfilter and pump.

Figure 4:
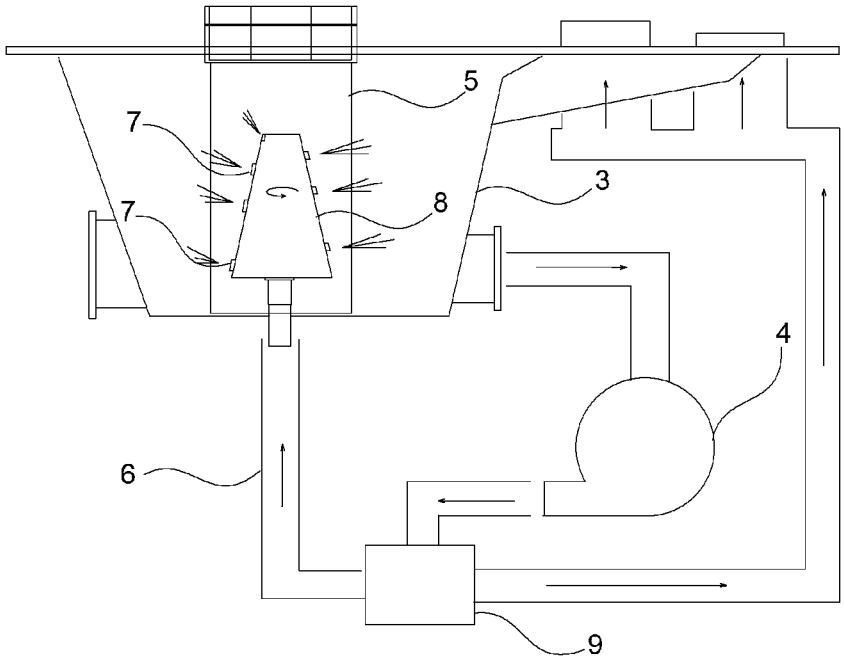

FIG. 4—is the schematic view of the receptacle, microfilter and pump relating to another embodiment of the present invention.

Figure 5:
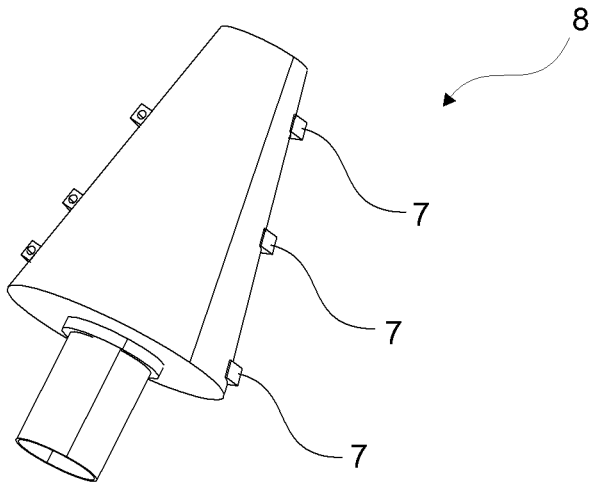

FIG. 5—is the perspective view of a sprayer.

Figure 6:
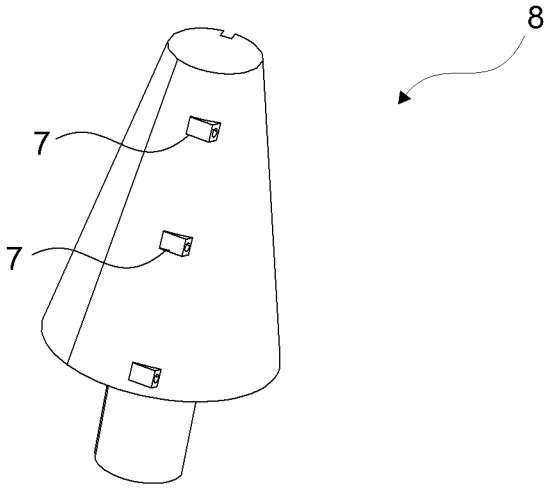

FIG. 6—is the perspective view of a sprayer from another angle.

Figure 7:
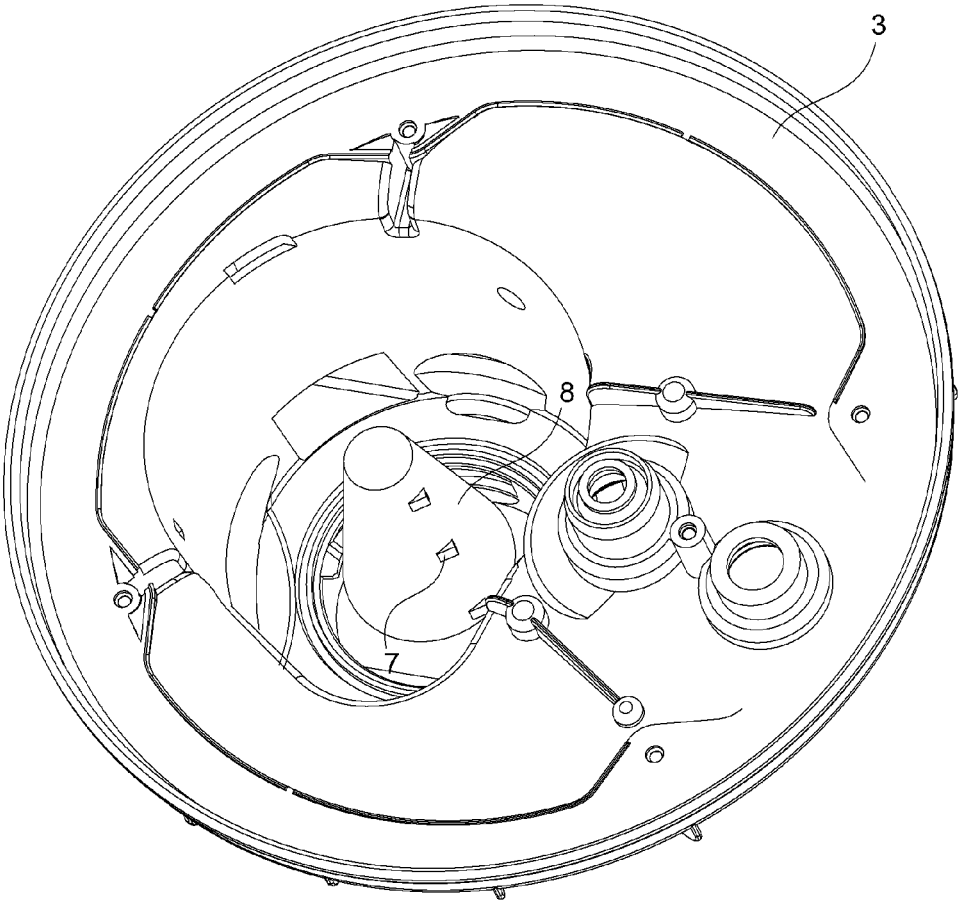

FIG. 7—is the perspective view of the receptacle in the situation that a sprayer is disposed into the receptacle.

Figure 8:
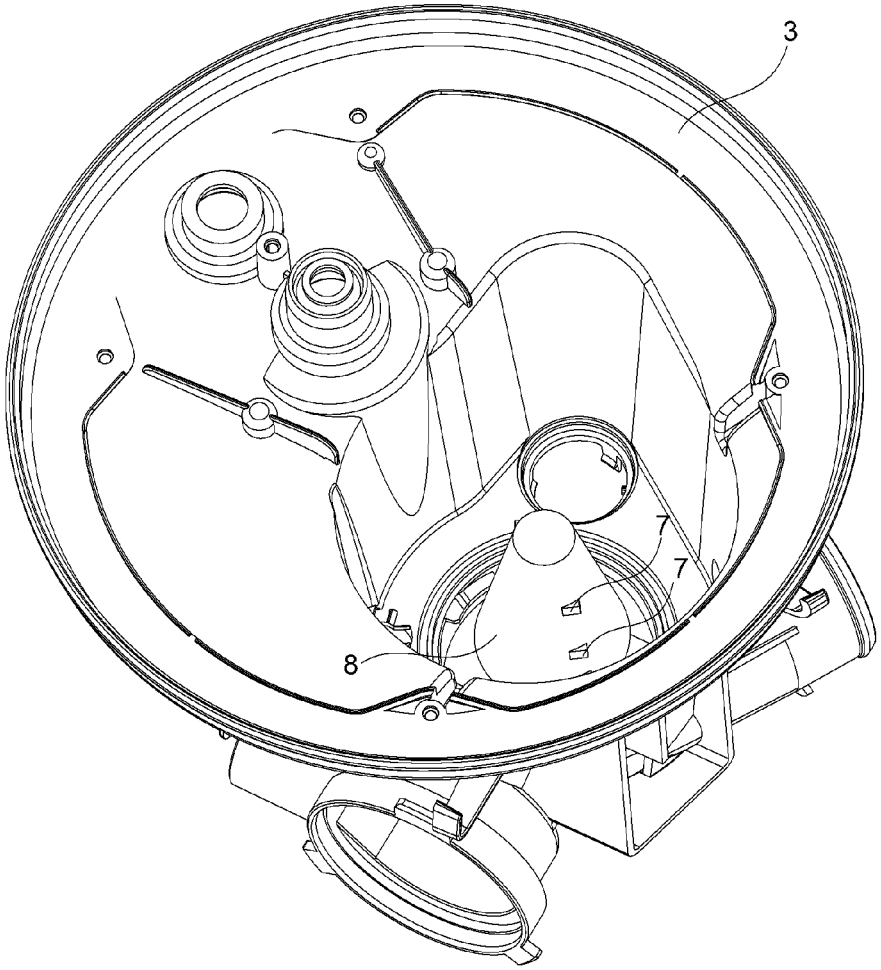

FIG. 8—is the perspective view of the receptacle from another angle in the situation that a sprayer is disposed into the receptacle.

The elements illustrated in the figures are numbered as follows:

1. Dishwasher
2. Washing tub
3. Receptacle
4. Pump
5. Microfilter
6. Additional line
7. Nozzle
8. Sprayer
9. Valve The dishwasher (1) of the present invention comprises a washing tub (2) wherein items to be washed are placed, a receptacle (3) which is located at the lower portion of the washing tub (2) and wherein the water in the washing tub (2) is collected during the washing process, a hollow cylindrical microfilter (5) which is located in the middle of the receptacle (3) and which holds the residues carried by the water that passes from the receptacle (3) to the water circulation or discharge line, a pump (4) which returns the water accumulating in the receptacle (3) to the washing tub (2), an additional line (6), one end of which is connected to the pump (4) and the other end opening to the middle of the microfilter (5), and a sprayer (8) which is disposed into the microfilter (5) and which has more than one nozzle (7) that are located on the surface of the sprayer (8) and that provide the water supplied from the pump (4) by means of the additional line (6) to be sprayed towards the inner surface of the microfilter (5) (FIG. 1, FIG. 3, FIG. 7 and FIG. 8).

The nozzles (7) are disposed such as to be almost tangential to the outer surface of the sprayer (8) and such that the exit direction of the water from their orifices are in the same radial direction, and the sprayer (8) rotates around its own axis by the moment effect created by the water that is sprayed through the nozzles (7) (FIG. 5 and FIG. 6). By the rotation of the sprayer (8), the water sprayed through the nozzles (7) hits the inner walls of the microfilter (5). By the impact force of the water to the inner walls of the microfilter (5), the residues adhered to the microfilter (5) surface are provided to fall off. Thus, the microfilter (5) is provided to clean itself without requiring the user to dismount and clean it.

During the washing, the residues and filths on the dishes being washed in the washing tub (2) are removed from the dishes with the water and mixed with the water accumulating in the receptacle (3). The water accumulating in the receptacle (3) is sucked by the pump (4) and the sucked water is directed to the washing tub (2) by means of the propellers after being passed through the microfilter (5). The filtration of the water directed to the washing tub (2) is provided by means of the microfilter (5), and the residues and filths that can be found inside the receptacle (3) are prevented from passing to the pump (4) (FIG. 1 and FIG. 3).

The water pumped by the pump (4) reaches inside of the sprayer (8) by means of the additional line (6). The orifices of the nozzles (7) located on the sprayer (8) are almost tangential to the sprayer (8) surface. The water exiting the nozzles (7) leaves the sprayer (8) surface by skimming the sprayer (8) surface. The nozzles (7) are disposed onto the sprayer (8) surface such that the exit direction of the water will always be tangential in the same radial direction. Thus, the water exiting the nozzles (7) provides the sprayer (8) to rotate by creating a moment force. The water exiting the nozzles (7) creates a vortex around the sprayer (8). The sprayer (8) sprays water to the microfilter (5) surface by rotating. Thus, the residues which accumulate in the receptacle (3) by being removed from the dishes and which adhere to the microfilter (5) surface are provided to be removed from the microfilter (5) surface. The residues and filths leaving the surface fall to the receptacle (3) base and are easily discharged outside from there by means of the discharge pump. By the microfilter (5) being cleaned, the filtration function is improved for next washings and therefore, the washing performance of the dishwasher (1) is increased.

In an embodiment of the present invention, the sprayer (8) rotates in the direction opposite to the direction of the natural vortex of the water that is formed inside the receptacle (3) during the suction of the pump (4). In this embodiment, the nozzles (7) are disposed onto the sprayer (8) surface such that their orifices will be in the direction opposite to the vortex direction of the water and tangential to the sprayer (8) surface. Thus, the sprayer (8) rotates in the direction opposite to the natural vortex direction of the water formed while flowing inside the receptacle (3). Consequently, the pump (4) is prevented from sucking the residues adhered on the microfilter (5) surface during the direction of the water to the washing tub (2). By means of the sprayer (8) rotating in the opposite direction to the pump (4), the efficiency of the processes of removing the residues and filths from the microfilter (5) surface and discharging them to the receptacle (3) base is increased.

In an embodiment of the present invention, the sprayer (8) is configured as a truncated cone. The cross-sectional area of the sprayer (8) narrows upwardly (FIG. 5 and FIG. 6). Thus, the rotational speed of the sprayer (8) is increased by the speed of the water, which reaches the upper end of the sprayer (8) by means of the additional line (6), being increased. Consequently, the cleaning efficiency of the microfilter (5) is increased.

In another embodiment of the present invention, the sprayer (8) is configured as a cylindrical form (FIG. 1 and FIG. 2). Thus, the production of the sprayer (8) is facilitated.

In another embodiment of the present invention, the sprayer (8) is located almost at the center of the microfilter (5) (FIG. 3, FIG. 4, FIG. 7 and FIG. 8). Thus, the water sprayed through the nozzles (7) is provided to hit all the surfaces of the microfilter (5) by being dispersed homogenously, and the residues and filths adhered to the microfilter (5) surface are provided to be cleaned.

In another embodiment of the present invention, the dishwasher (1) comprises a valve (9) located on the additional line (6) (FIG. 2 and FIG. 4). The water supplied to the sprayer (8) is controlled by the valve (9). Thus, the cleaning of the microfilter (5) can be realized in a controlled manner.

In another embodiment of the present invention, before the water inside the receptacle (3) is discharged at the end of the rinsing step, the valve (9) sends the water only to the additional line (6) and thus, provides the microfilter (5) to be cleaned. The dishwasher (1), furthermore, has a control unit that provides the water to be directed to the valve (9). The control unit directs the water accumulating in the receptacle (3) at the end of the rinsing step to the additional line (6) through the valve (9). The water reaching the sprayer (8) from the additional line (6) is sprayed through the nozzles (7) and thus, the microfilter (5) is provided to be cleaned. Consequently, after the rinsing step is completed, the residues accumulating on the inner surface of the microfilter (5) during the main washing step are provided to be removed from the inner surface of the microfilter (5). Since no circulation process is performed inside the washing tub (2) after the rinsing step, adhering of residues onto the surface of the microfilter (5) again is eliminated.

In another embodiment of the present invention, the control unit executes a microfilter (5) cleaning step which is independent of the washing steps, provides water to be received into the receptacle (3) and discharged. In this embodiment, the user is enabled to select the microfilter (5) cleaning step by means of the user interface. The user selects the microfilter (5) cleaning step by means of the user interface at the end of a certain number of cycles and provides the control unit to execute this said step. Thus, the user is enabled to clean the microfilter (5) at any desired time.

By means of the present invention, the residues accumulating on the inner surface of the microfilter (5) are removed by means of the sprayer (8), which is disposed in the microfilter (5) and sprays water to the inner surface of the microfilter (5) by rotating, and thus, the microfilter (5) is provided to be cleaned without any user intervention.

It is to be understood that the present invention is not limited to the embodiments disclosed above and a person skilled in the art can easily introduce different embodiments. These different embodiments should also be considered within the scope of the claims of the present invention, too.

The invention claimed is:

1. A dishwasher (1) comprising a washing tub (2) wherein items to be washed are placed, a receptacle (3) which is located at a lower portion of the washing tub (2) and wherein the water in the washing tub (2) is collected during the washing process, a hollow cylindrical microfilter (5) which is located in the middle of the receptacle (3) and which holds the residues carried by the water that passes from the receptacle (3) to the water circulation or discharge line, a pump (4) which returns the water accumulated in the receptacle (3) to the washing tub (2), an additional line (6) different from water returned to the pump, one end of which is connected to the pump (4) and the other end opening to the middle of the microfilter (5), and a sprayer (8) having a surface and which is disposed into the microfilter (5) and which has more than one nozzle (7) that are located directly on the surface of the sprayer (8) and that provide the water to be sprayed towards the inner surface of the microfilter (5), wherein the nozzles (7) which are disposed such as to be almost tangential to the outer surface of the sprayer (8) and such that the exit direction of the water from their orifices will be in the same radial direction, and the sprayer (8) which rotates around its own axis by the moment effect created by the water that is sprayed through the nozzles (7) and wherein the water to be sprayed by the nozzles is received from the receptacle and is supplied from the pump by means of the additional line, wherein the sprayer (8) is configured as a truncated cone.

2. The dishwasher (1) as in claim 1, wherein the sprayer (8) rotates in the direction opposite to the direction of the natural vortex of the water that is formed inside the receptacle (3) during the suction of the pump (4).

3. The dishwasher (1) as in claim 1 or 2, further comprising a valve (9) is located on the additional line (6) to control water flow to both the sprayer the additional line and return from the pump to the tub.

4. The dishwasher (1) as in claim 3, wherein the valve (9) which provides the microfilter (5) to be cleaned by sending the water only to the additional line (6) before the water inside the receptacle (3) is discharged at the end of the rinsing step.

5. The dishwasher (1) as in claim 1 or 2, further comprising a control unit which, independent of the washing steps, executes a microfilter (5) cleaning step that provides water to be received into the receptacle (3) and discharged.

* * * * *